United States Patent [19]

Lee

[11] Patent Number: 4,909,051

[45] Date of Patent: Mar. 20, 1990

[54] KEEPER PLATE FOR STRAP HANDCUFFS

[76] Inventor: James A. Lee, 190 W. Highlander Rd., Harvest, Ala. 35749

[21] Appl. No.: 347,982

[22] Filed: May 4, 1989

[51] Int. Cl.[4] ..... E05B 75/00

[52] U.S. Cl. ..... 70/16; 128/878; 248/74.3

[58] Field of Search ..... 70/15-17; 24/16 PB; 128/878-880; 292/317, 323, 325; 248/74.3

[56] References Cited

U.S. PATENT DOCUMENTS

| | | | |
|---|---|---|---|
| 372,510 | 11/1887 | Bean | 70/16 |
| 375,945 | 1/1888 | McDonald | 70/16 |
| 1,056,079 | 3/1913 | Wood | 70/16 |
| 1,456,846 | 5/1923 | Gamwell | 70/16 |
| 3,616,665 | 11/1971 | Rosenthal | 70/16 |
| 3,654,669 | 4/1972 | Fulton | 24/16 PB |
| 3,740,977 | 6/1973 | Stefansen et al. | 70/16 |
| 4,071,023 | 1/1978 | Gregory | 70/16 X |
| 4,138,867 | 2/1979 | Tompkins | 70/16 |

FOREIGN PATENT DOCUMENTS

| | | | |
|---|---|---|---|
| 429712 | 9/1911 | France | 292/325 |

*Primary Examiner*—Lloyd A. Gall

*Attorney, Agent, or Firm*—Joseph H. Beumer

[57] ABSTRACT a keeper plate for use with strap handcuffs is disclosed. The plate in one embodiment for a single handcuff is generally rectangular, with flattened concave edges disposed on its longer sides and strap-receiving channels extending through its shorter sides. The flattened concave edges generally conform to the shape of the palm side of a human wrist and enable a strap handcuff to be tightened securely with minimized danger of cutting off circulation. In another embodiment for a pair of handcuffs, the plate is elongated and has a channel for receiving one strap handcuff disposed spaced apart from a flattened concave edge at each end. This enables securing of limbs without bringing them closely together. Holes may be provided in the plates to enable tying to other straps or other objects.

9 Claims, 2 Drawing Sheets

KEEPER PLATE FOR STRAP HANDCUFFS

FIELD OF THE INVENTION

This invention relates generally to restraining devices and more particularly to a keeper plate for use with strap-type handcuffs.

BACKGROUND OF THE INVENTION

Disposable strap-type handcuffs are coming into widespread use by law enforcement agencies. These devices are made up of an elongated strap of a strong plastic such as nylon, with a head mounted on one end. The head is provided with a single high-strength steel barb for engagement with the strap near its other end when threaded through the head. A central groove runs the entire length of the strap, permitting it to be locked in an infinite number of positions. This provides a one-way locking action. The strap may be tightened by pulling, but once in place, it may not be loosened. As a result, the strap is not removable for reuse, but rather is removed by cutting and is then discarded. Such a device is available from Becton Dickenson under the designation FLEX-CUF®. Strap-type handcuffs provide important advantages in that they are lightweight and are easily carried in large numbers, thus expediting the application of restraints in mass arrest situations. They also are inexpensive, have high strength, and are readily adaptable to various methods of application for binding hands together with feet or immovable objects.

A problem associated with the use of strap handcuffs of the type described above is that only a slight margin exists between having the straps engaged so loosely that the prisoner's hands can be worked free or so tightly that circulation is cut off. The strap is relatively narrow and may be readily pulled tight enough to cut off blood circulation, particularly on the palm side of the wrist. Thus a high degree of caution has been required in applying such handcuffs.

Various prior patents disclose strap-type handcuffs and conventional metal handcuffs with shields or plates disposed between closeable bracelets. These patents include U.S. Pat. Nos. 4,071,023; 3,740,977; 3,616,665; and 375,945. None of these patents, however, discloses use of a keeper plate to enable fastening strap handcuffs securely with less danger of cutting off a prisoner's circulation.

SUMMARY OF THE INVENTION

This invention is directed to a keeper plate for use in combination with strap handcuffs. The plate is generally rectangular with a pair of flattened concave sides and a pair of ends with channels slightly spaced apart from the edges thereof to engage portions of the strap that are threaded therethrough. The flattened concave sides generally conform to the shape of the palm side of the human wrist, providing a surface against which the wrist may be securely placed. The plate is thicker than the width of the strap and has smooth edge surfaces so that pressure against the wrist and blood vessels placed against the surfaces is less than would be provided by the strap alone, thus reducing the risk of cutting off circulation. The channels extending across the ends are sized to enable the strap to be threaded therethrough and to be slid as required in application to a prisoner. For use with a strap of rectangular cross section, the channels would likewise have a rectangular cross section and would be disposed edgewise within the plate.

Keeper plates embodying the invention substantially lessen the danger of cutting off circulation and increase the present narrow margin in using such handcuffs between having them loose enough to allow removal or tight enough to cause an inhumane and dangerous result.

It is, therefore, an object of this invention to provide a keeper plate for use with strap handcuffs that enables the strap to be tightened securely with lessened danger of cutting off circulation.

Another object is to provide such a keeper plate that provides for quick and effective engagement of the handcuffs.

DESCRIPTION OF THE PREFERRED EMBODIMENT

Figure 1:
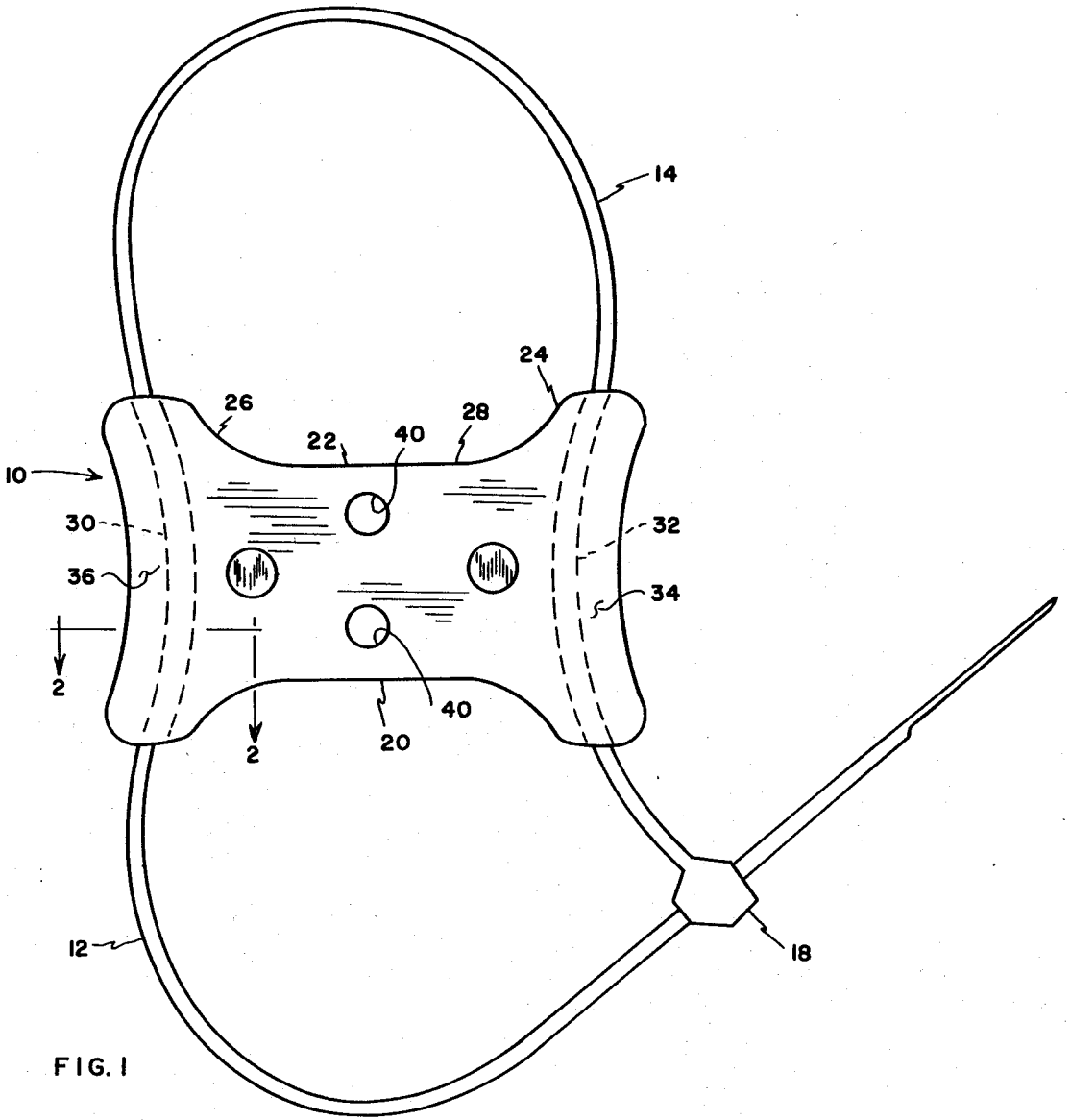
FIG. 1 is a planar view of an embodiment of the invention for use with a single strap handcuff.
Figure 2:
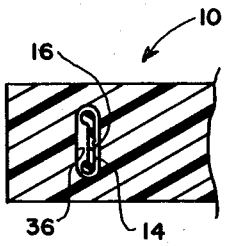
FIG. 2 is an elevational sectional view taken along line 2—2 of FIG. 1.

Referring to FIG. 1 in the drawings, there is shown a keeper plate 10 engaged with and supporting a strap handcuff 12. The handcuff is a generally rectangular strap 14 having a groove 16 on its inner side (FIG. 2) and head 18 affixed to one end. The head has a steel barb (not shown) for engaging the groove side of the strap so as to allow the strap to be loosened but not tightened.

The keeper plate 10 is of generally rectangular shape and has an opposing pair of flattened concave sides 20, 22 each side including near each end outwardly curved portions 24, 26 and a straight portion 28 therebetween. The resulting shape of the sides conforms to the shape of the flat palm side of a human wrist and distributes pressure over a large area of the wrist. In normal use, a single strap handcuff is disposed around both wrists of a prisoner, forming a completed circle around each wrist.

Channels 30, 32 traverse end regions 34, 36 of the plate and are spaced apart from the edges thereof. The shape of the channels conforms to the shape of the strap, and the channels are sized to allow the strap to be threaded therethrough and to slide once threaded. The channels are disposed edgewise within the plate to guide the strap so that its longest side contacts the wrist. In the embodiment shown, ends 34, 36 have concave edges, and the channels are uniformly spaced apart therefrom so that the channels impart an outward turn to the straps where they emerge from the channels, thus providing further conformance to the overall shape of the wrist.

Although not critical to the invention, the embodiment shown is made of two halves of plastic material each including half of the channels, the halves being bonded together by an adhesive and further secured by rivets . The plate may also be molded in a single piece by use of suitable techniques. The plate may also be made of other materials such as metal. The plate may include a plurality of holes 40 for receiving other straps for purposes such as securing the plate to straps attached to the prisoner's waist, leg restraints, or an immovable object.

Figure 3:
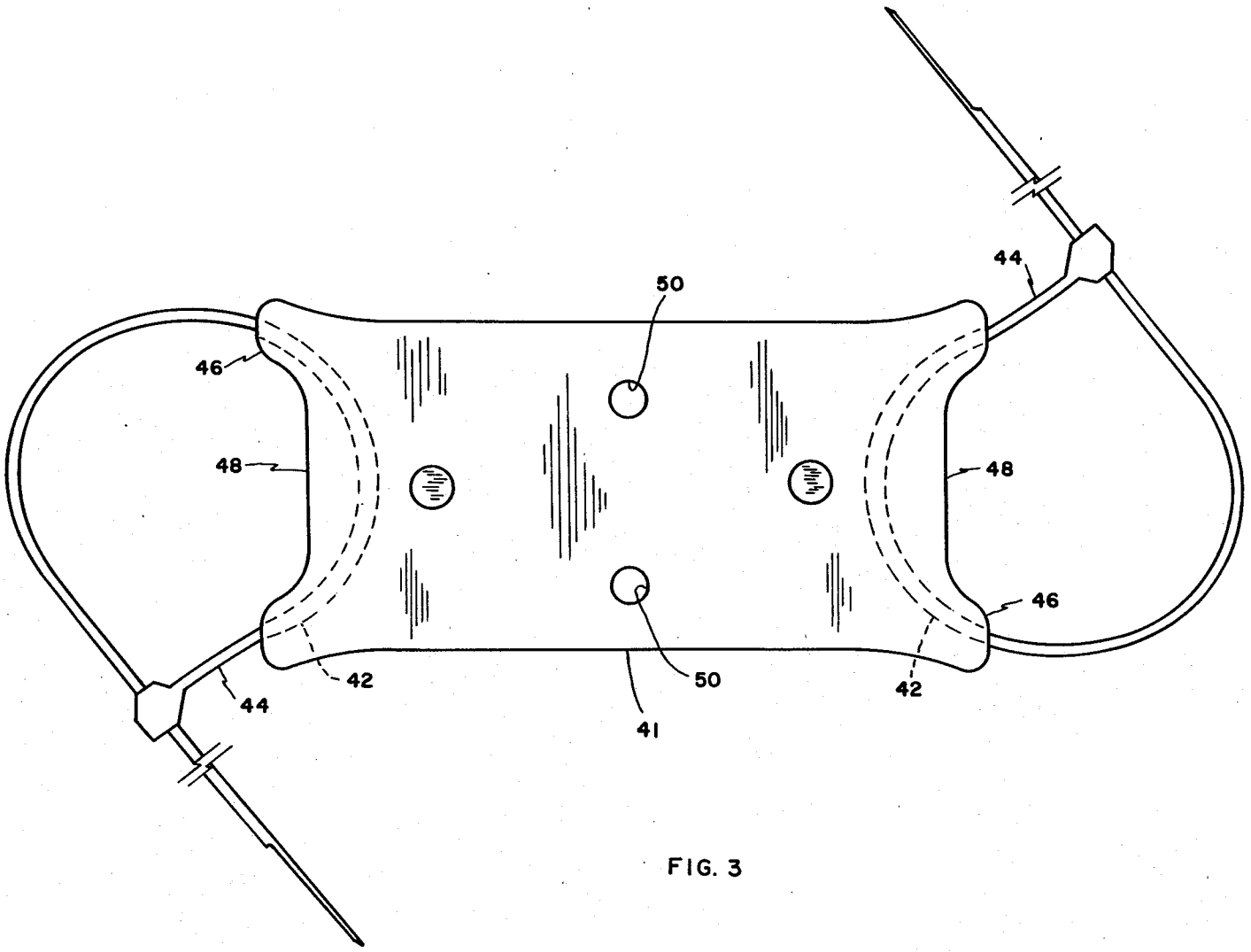
FIG. 3 is a planar view of an embodiment of the invention for use with a pair of strap handcuffs.

FIG. 3 shows an alternate embodiment wherein the keeper plate 41 has an elongated, generally rectangular shape, with a pair of channels 42 for receiving straps 44 being disposed and spaced apart from ends 46 where wrist-receiving flattened concave edges 48 are located instead of in the sides between those ends as shown in FIG. 1. The embodiment of FIG. 3 is adapted for use with a pair of strap handcuffs, one being placed at each end of the keeper plate. Holes 50 for receiving other straps may be placed near the middle of plate 41 to enable insertion of other straps as may be required in a particular situation. The elongated plate of FIG. 3 provides for a greater distance between the wrists and enables the prisoner's hands to be secured behind their backs with reduced discomfort, particularly for those who have difficulty bringing their hands together in such a position.

The keeper plates described above makes reference to their having edges that generally conform to the shape of the human wrist. It is to be understood, however, that they are equally effective for use in restraining a prisoner's legs where the margin between effective restraint and cutting off circulation is not as great. Unlike the strap handcuffs with which the keeper plates of this invention are intended for use, the keeper plates are not disposable but may be recovered and reused indefinitely.

Although the invention is illustrated above in terms of specific embodiments, it is not to be understood as limited thereby but is limited only as indicated by the appended claims.

I claim:

1. A keeper plate for receiving and securing a strap handcuff around at least one limb of a prisoner comprising:

a generally rectangular plate having an opposing pair of generally concave sides including a flattened middle portion for receiving said limb and a pair of ends between said sides; and each of said ends having spaced apart from its edge a strap-receiving channel extending therethrough from one of said sides to the other whereby said strap handcuff may be threaded through such channels and tightened around said limb.

2. A keeper plate as defined as claim 1 wherein said channels have a generally rectangular cross section.

3. A keeper plate as defined as claim 2 wherein said ends have a concave shape, and said channels are uniformly spaced apart from the edges thereof.

4. A keeper plate as defined as claim 3 including at least one strap-receiving hole penetrating the thickness thereof.

5. A keeper plate as defined as claim 4 wherein said flattened concave edges generally conform to the shape of the palm side of the human wrist.

6. A keeper plate for receiving and securing a pair of strap handcuffs comprising:

an elongated generally rectangular plate having an opposing pair of generally concave ends including a flattened middle portion and a pair of elongated sides between said ends; and each of said ends having spaced apart from its edge a strap-receiving channel extending therethrough and terminating at locations outside said flattened middle portion whereby said strap handcuff may be threaded therethrough and tightened around a limb of a prisoner.

7. A keeper plate as defined as claim 6 wherein said channels have a generally rectangular cross section.

8. A keeper plate as defined as claim 7 wherein the edges of said flattened concave ends generally conform to the shape of the palm side of a human wrist.

9. A keeper plate as defined as claim 8 including at least one strap-receiving hole penetrating the thickness thereof.

* * * * *